US009367020B1

(12) United States Patent
Rokutan et al.

(10) Patent No.: US 9,367,020 B1
(45) Date of Patent: Jun. 14, 2016

(54) CLEANING MEMBER, PROCESS CARTRIDGE, AND IMAGE FORMING APPARATUS

(71) Applicant: FUJI XEROX CO., LTD., Tokyo (JP)

(72) Inventors: Minoru Rokutan, Kanagawa (JP); Fuyuki Kano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/703,161

(22) Filed: May 4, 2015

(30) Foreign Application Priority Data

Dec. 24, 2014 (JP) ..... 2014-259692

(51) Int. Cl.
*G03G 21/00* (2006.01)
*G03G 15/02* (2006.01)
*G03G 15/16* (2006.01)

(52) U.S. Cl.
CPC ..... *G03G 21/0058* (2013.01); *G03G 15/0225* (2013.01); *G03G 15/168* (2013.01); *G03G 2215/1647* (2013.01); *G03G 2221/0089* (2013.01)

(58) Field of Classification Search
CPC ..... G03G 15/0225; G03G 15/166; G03G 15/161; G03G 15/168; G03G 15/2075; G03G 15/2025; G03G 21/0058; G03G 2215/1647; G03G 2215/1652; G03G 2215/1657; G03G 2215/1661; G03G 2221/0089
USPC ..... 399/99, 100, 101, 326, 357
See application file for complete search history.

(56) References Cited

U.S. PATENT DOCUMENTS

| | | | | |
|---|---|---|---|---|
| 8,467,697 | B2 * | 6/2013 | Kawai et al. | 399/100 |
| 8,515,304 | B2 * | 8/2013 | Hagiwara et al. | 399/100 |
| 8,755,710 | B2 * | 6/2014 | Aoyagi et al. | 399/100 |
| 2011/0170899 | A1 * | 7/2011 | Kawahara | 399/100 |
| 2013/0108311 | A1 * | 5/2013 | Kawai et al. | 399/100 |

FOREIGN PATENT DOCUMENTS

| | | | |
|---|---|---|---|
| JP | 2011145412 A | * | 7/2011 |
| JP | 2012103641 A | * | 5/2012 |
| JP | 2012181299 A | * | 9/2012 |
| JP | 2014-153551 A | | 8/2014 |

* cited by examiner

*Primary Examiner* — Robert Beatty
(74) *Attorney, Agent, or Firm* — Oliff PLC

(57) ABSTRACT

A cleaning member includes a core, and an elastic layer including a strip-shaped elastic member that is spirally wound around a region of an outer peripheral surface of the core ranging from one end to another end of the core, wherein a width W1 of the elastic layer is less than or equal to a radius R of the core and is 1 mm or more.

9 Claims, 10 Drawing Sheets

CLEANING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-259692 filed Dec. 24, 2014.

BACKGROUND

Technical Field

The present invention relates to a cleaning member, a process cartridge, and an image forming apparatus.

In an electrophotographic image forming apparatus, first, a surface of an image holding member including a photoreceptor is charged by a charging device to form a charge, and then an electrostatic latent image is formed using, laser beams in which image signals are modulated, or the like. Next, the electrostatic latent image is developed using charged toner, thereby forming a visualized toner image. The toner image is electrostatically transferred onto a transfer medium such as a recording sheet directly or through an intermediate transfer medium, and then is fixed on the transfer medium. As a result, an image is obtained.

SUMMARY

According to an aspect of the invention, there is provided a cleaning member including:

a core; and an elastic layer including a strip-shaped elastic member that is spirally wound around a region of an outer peripheral surface of the core ranging from one end to another end of the core, wherein a width W1 of the elastic layer is less than or equal to a radius R of the core and is 1 mm or more.

BRIEF DESCRIPTION OF THE DRAWINGS

Exemplary embodiments of the present invention will be described in detail based on the following figures, wherein.

DETAILED DESCRIPTION

Figure 1:
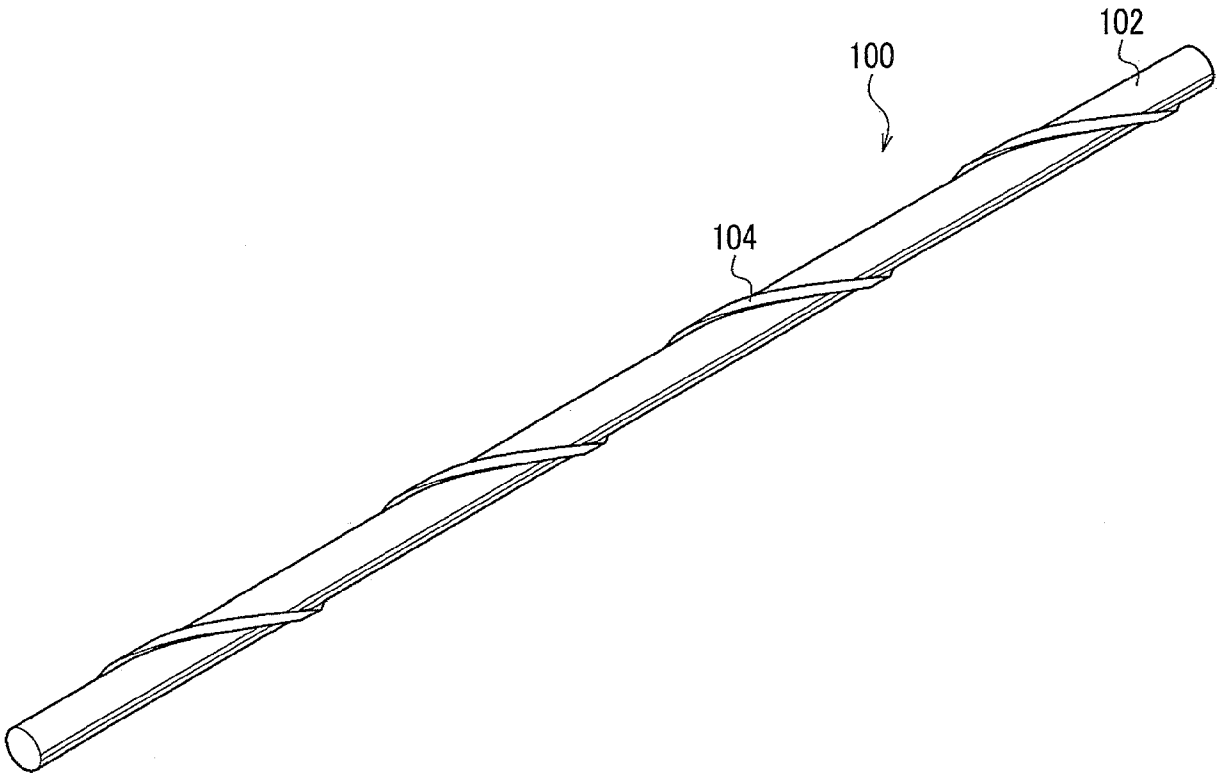
FIG. 1 is a perspective view schematically showing a cleaning member according to an exemplary embodiment.

Hereinafter, an exemplary embodiment which is an example of the invention will be described. In all the drawings, members having the same function and action are represented by the same reference numeral, and the description thereof will not be repeated in some cases.

Cleaning Member

Figure 2:
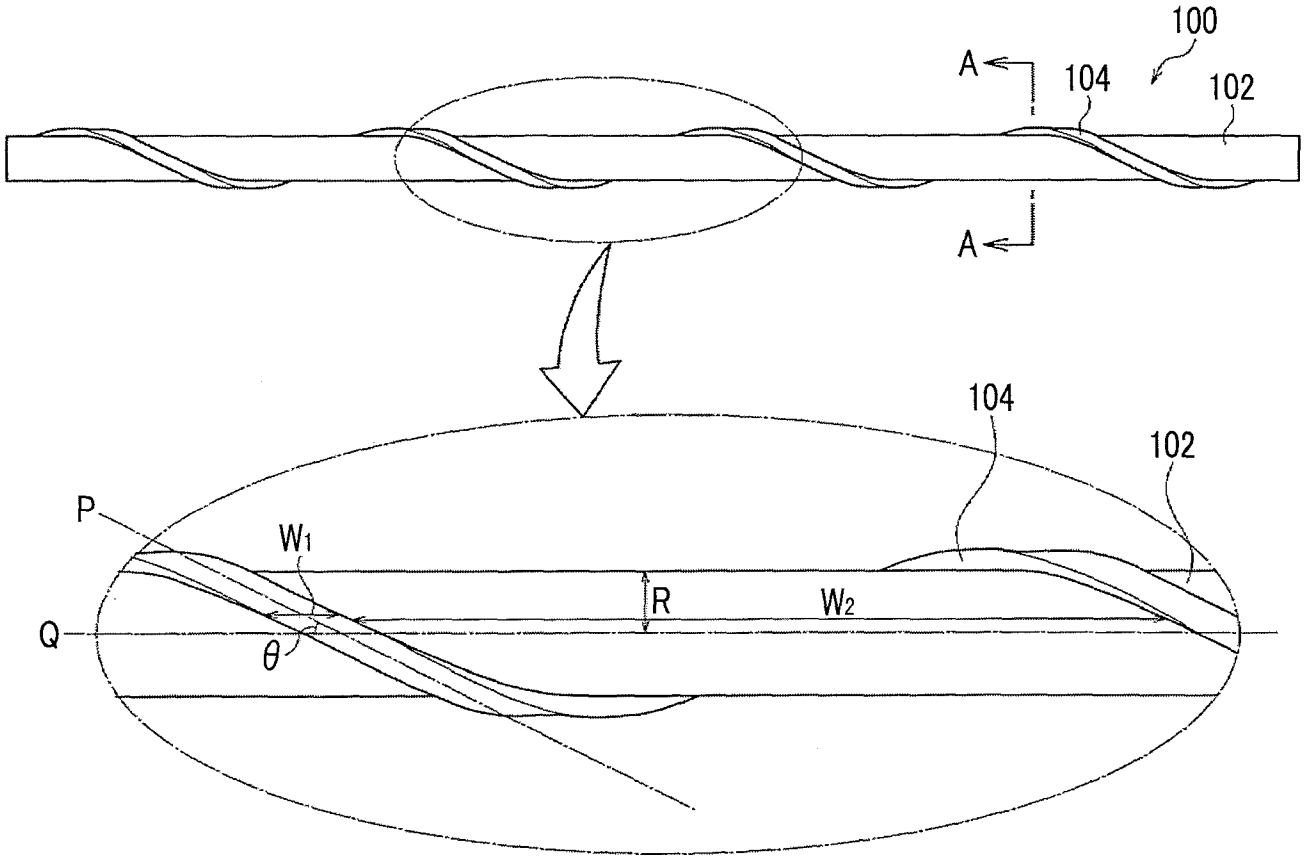
FIG. 2 is a plan view schematically showing the cleaning member according to the exemplary embodiment.
Figure 3:
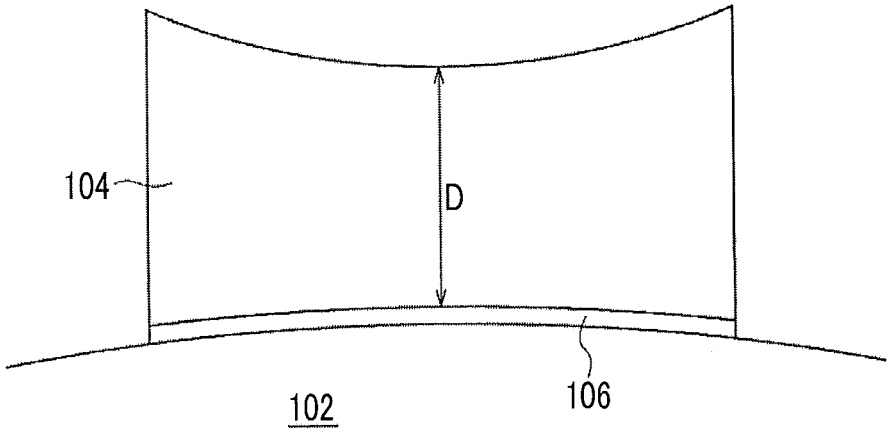
FIG. 3 is an enlarged cross-sectional view showing an elastic layer in the cleaning member according to the exemplary embodiment.

FIG. 1 is a perspective view schematically showing a cleaning member according to an exemplary embodiment. FIG. 2 is a plan view schematically showing the cleaning member according to the exemplary embodiment. FIG. 3 is an enlarged cross-sectional view showing an elastic layer in the cleaning member according to the exemplary embodiment.

FIG. 3 is a cross-sectional view taken along line A-A of FIG. 2, that is, a view of a cross-section obtained by cutting the elastic layer along a peripheral direction of a core.

As shown in FIGS. 1 to 3, a cleaning member 100 according to the exemplary embodiment is a roll-shaped member that includes, for example, a core 102, an elastic layer 104, and an adhesive layer 106 that bonds the core 102 and the elastic layer 104 to each other.

For example, the elastic layer 104 is spirally disposed around an outer peripheral surface of the core 102. The elastic layer 104 is formed by a strip-shaped elastic member 108 (refer to FIGS. 6A to 6C; hereinafter, also referred to as "strip 108") being spirally wound around a region ranging from one end to another end of the core 102. Specifically, for example, the elastic layer 104 is disposed in a state where the strip 108 is spirally wound around the region ranging from one end to another end of the core 102 at predetermined intervals with the core 102 as a screw axis.

Here, in a case where the elastic layer 104 is spirally disposed around the outer peripheral surface of the core 102 by winding the strip 108 around the core 102, when the strip 108 is wound around the outer peripheral surface of the core 102, a considerable amount of tension is applied in a longitudinal direction thereof (winding direction) in some cases. When the tension is applied during the winding of the strip 108, it is considered that the elastic layer 104 wound around the core 102 is disposed in an elastically deformed state (for example, being reduced in size relative to the thickness thereof at the center in the width direction of the strip 108 before the winding). On the other hand, even when the tension is not applied during the winding of the strip 108, it is considered that the elastic layer 104 may be elastically deformed because it is wound according to the curvature of the outer peripheral surface of the core 102.

On the other hand, the elastic layer 104 wound around the core 102 is fixed along the outer peripheral surface of the core 102 in the elastically deformed state. Therefore, it is considered that an elastic repulsive force (restoring force of the elastic layer) corresponding to the elastic deformation amount of the elastic layer 104 is generated. The restoring force of the elastic layer works in a shrinking direction of the elastic layer 104, that is in a direction along the longitudinal direction of the elastic layer 104 (the winding direction of the strip 108). Therefore, it is considered that the restoring force is applied in a direction in which one end or both ends of the elastic layer 104 in the longitudinal direction are peeled off from the outer peripheral surface of the core 102. As a result, the end of the elastic layer in the longitudinal direction is likely to be peeled off from the core during storage. It is considered that, as the thickness and elastic modulus of the elastic layer 104 or the curvature of the core increases, the restoring force of the elastic layer works more strongly.

In particular, when the elastic layer 104 wound around the core 102, that is, the cleaning member 100 is stored in a high-temperature and high-humidity environment (for example, 45° C./95% RH), the end of the elastic layer in the longitudinal direction is likely to be peeled off from the core by being exposed to the high-temperature and high-humidity environment. On the other hand, even in a case where the end of the elastic layer in the longitudinal direction is not peeled off from the core after storage, by the elastic layer contacting a cleaning object during cleaning, the end of the elastic layer in the longitudinal direction is likely to be peeled off from the core.

In the related art, in order to prevent the peeling of the end of the elastic layer in the longitudinal direction, the end of the elastic layer in the longitudinal direction is pressed and bonded to the core by, for example, heat or ultrasonic waves in advance. However, this procedure requires a pressure-bonding step, which leads to an increase in the manufacturing cost.

On the other hand, in the cleaning member 100 according to the exemplary embodiment, a width W1 of the elastic layer 104 is less than or equal to a radius R of the core 102 and is 1 mm or more. Here, the width W1 of the elastic layer 104 refers to the length of the elastic layer 104 along an axial direction Q (core axial direction) of the cleaning member 100 in a state where the strip-shaped elastic member 108 is spirally wound around the region ranging from one end to another end of the core 102 as shown in FIG. 2.

The cleaning member 100 according to the exemplary embodiment includes the core 102 having the above-described configuration. Therefore, even when being stored in a high-temperature and high-humidity environment, the peeling of the end of the elastic layer in the longitudinal direction from the core can be prevented without performing a pressure-bonding treatment on the end of the elastic layer in the longitudinal direction. Here, in the exemplary embodiment, "the peeling of the end of the elastic layer in the longitudinal direction from the core" specifically refers to, for example, the following phenomena occurring when the cleaning member 100 is stored in a high-temperature and high-humidity environment: 1) a phenomenon in which the end of the elastic member in the longitudinal direction is peeled off from the core by the cleaning member being exposed to a high-temperature and high-humidity environment; and 2) a phenomenon in which the end of the elastic member in the longitudinal direction is peeled off from the core by the elastic layer contacting the cleaning object during cleaning after the cleaning member is stored in a high-temperature and high-humidity environment. By using the cleaning member 100 according to the exemplary embodiment, the above-described phenomena 1) and 2) are prevented. Further, since it is not necessary to perform a pressure-bonding treatment on the end of the elastic layer in the longitudinal direction, a high-quality cleaning member can be provided at a low price.

The reason therefor is not clear but is presumed to be as follows.

As the width W1 of the elastic layer 104 is decreased, the deformation amount of the elastic layer 104 spirally wound around the core 102 is decreased. In the elastic layer 104 with the deformation amount decreased, the restoring force is also decreased.

On the other hand, the restoring force of the elastic layer 104 is affected by the curvature of the core 102. Specifically, as the curvature of the core 102 is increased, the restoring force of the elastic layer 104 is increased.

Therefore, in the cleaning member 100 according to the exemplary embodiment, the width W1 of the elastic layer 104 is adjusted to less than or equal to the radius R of the core 102 in consideration of a relationship between the deformation amount of the elastic layer 104, and the restoring force of the elastic layer 104 and the curvature of the core 102. As a result, the deformation amount of the elastic layer 104 is decreased, and the restoring force of the elastic layer 104 corresponding to the curvature of the core 102 is also decreased. On the other hand, by adjusting the width W1 of the elastic layer 104 to be 1 mm or more, the contact area between the elastic layer 104 and the core 102 is secured, and the adhesive force is improved. As a result, even when being stored in a high-temperature and high-humidity environment, the peeling of the end of the elastic layer in the longitudinal direction from the core can be prevented without performing a pressure-bonding treatment on the end of the elastic layer in the longitudinal direction.

In a charging device, a transfer device, a unit for an image forming apparatus, a process cartridge, and an image forming apparatus which include the cleaning member 100 having the above-described configuration, a decrease in performance due to failure in cleaning of a cleaning object (for example, a charging member or a transfer member) is prevented.

Hereinafter, each member will be described.

First, the core 102 will be described.

Examples of a material used for the core 102 include metal, an alloy, or a resin.

Examples of the metal or the alloy include metal such as iron (free-cutting steel), copper, brass, aluminum, or nickel; and an alloy such as stainless steel.

Examples of the resin include polyacetal resins; polycarbonate resins; acrylonitrile-butadiene-styrene copolymer resins; polypropylene resins; polyester resins; polyolefin resin; polyphenylene ether resins; polyphenylene sulfide resins; polysulfone resins; polyether sulfone resins; polyarylene resins; polyether imide resins; polyvinyl acetal resins; polyketone resins; polyether ketone resins; polyether ether ketone resins; polyaryl ketone resins; polyether nitrile resins; liquid crystal resins; polybenzimidazole resins; polyparabanic acid resins; vinyl polymer or copolymer resins obtained by polymerization or copolymerization of at least one vinyl monomer selected from the group consisting of an aromatic alkenyl compound, a methacrylate, an acrylate, and a vinyl cyanide compound; diene-aromatic alkenyl compound copolymer resins; vinyl cyanide-diene-aromatic alkenyl compound copolymer resins; aromatic alkenyl compound-diene-vinyl cyanide-N-phenylmaleimide copolymer resins; vinyl cyanide-(ethylene-diene-propylene (EPDM))-aromatic alkenyl compound copolymer resins; vinyl chloride resins; and chlorinated polyvinyl chloride resins. Among these resins, one kind may be used alone, or two or more kinds may be used in combination.

It is preferable that the material, a surface treatment method, and the like are optionally selected. In particular, when the core 102 is formed of metal, it is preferable that the metal is plated. In addition, when the core 102 is formed of a non-conductive material such as a resin, the non-conductive material may be used as it is or may be treated to be conductive through a general treatment such as plating.

Next, the elastic layer 104 will be described.

The elastic layer 104 refers to a layer formed of a material which returns to the original shape even when being deformed due to the application of an external force of 100 Pa. The elastic layer 104 may be a foaming elastic layer or a non-foaming elastic layer. The elastic layer 104 is preferably a foaming elastic layer from the viewpoint of cleaning property. The foaming elastic layer refers to a layer formed of a material (so-called foam) having bubbles.

Examples of the material of the elastic layer 104 include foaming resins such as polyurethane, polyethylene, polyamide, and polypropylene; and rubber materials such as silicone rubber, fluororubber, urethane rubber, EPDM (ethylene propylene diene rubber), NBR (acrylonitrile-butadiene rubber), CR (chloroprene rubber), chlorinated polyisoprene, isoprene, styrene-butadiene rubber, hydrogenated polybutadiene, and butyl rubber. Among these materials, one kind may be used alone, or two or more kinds may be used in combination.

Various auxiliary agents such as a foaming agent, a foam stabilizer, a catalyst, a curing agent, a plasticizer, or a vulcanizing accelerator may be added to the material.

In particular, from the viewpoint of preventing the surface of the cleaning object from being scratched by being rubbed and from being torn or damaged for a long period of time, it is preferable that the elastic layer 104 is a polyurethane foam having high tension resistance.

Examples of the polyurethane foam include a reaction product of polyol (for example, polyester polyol, polyether polyol, or acryl polyol) and isocyanate (for example, 2,4-tolylene diisocyanate, 2,6-tolylene diisocyanate, 4,4-diphenylmethane diisocyanate, tolidine diisocyanate, or 1,6-hexamethylene diisocyanate), which may be further allowed to react with a chain extender (1,4-butanediol or trimethylolpropane).

In general, the foaming of polyurethane is performed using a foaming agent such as water or an azo compound (for example, azodicarbonamide or azobisisobutyronitrile).

Auxiliary agents such as a foaming agent, a foam stabilizer, or a catalyst may be added to the polyurethane foam.

Among these polyurethane foams, an ether polyurethane foam is preferable used because an ester polyurethane foam is likely to undergo hygrothermal aging. For the ether polyurethane, silicone oil is mainly used as a foam stabilizer, but the silicone oil may be transferred to the cleaning object (for example, a charging roller) during storage (in particular, storage in a high-temperature and high-humidity environment) to cause defect in image quality. Therefore, by using a foam stabilizer other than silicone oil, the transfer of the foam stabilizer to the cleaning object is prevented, and deterioration in image quality caused by the transfer of the foam stabilizer is prevented.

Specific examples of the foam stabilizer other than silicone oil include an organic surfactant not including Si (for example, an anionic surfactant such as dodecylbenzenesulfonic acid or sodium lauryl sulfate). In addition, a method not using a silicone foam stabilizer described in JP-A-2005-301000 may also be applied.

Whether or not the foam stabilizer other than silicone oil is used in the ether polyurethane foam can be determined by determining whether or not the foam stabilizer contains "Si" through component analysis.

The width W1 (hereinafter, also referred to as "spiral width W1") of the elastic layer 104 is less than or equal to the radius R of the core 102, that is, ½ or less of the diameter of the core. From the viewpoint of decreasing the peeling of the end of the elastic layer in the longitudinal direction, the width W1 of the elastic layer 104 is preferably from ¼ to ½ and more preferably from ⅓ to ½ of the diameter of the core. The spiral width W1 has the same definition as described above.

In addition, the spiral width W1 is 1 mm or more, preferably 1.5 mm or more, and more preferably 2 mm or more. Although depending on a spiral angle θ, the upper limit of the spiral width W1 is not particularly limited as long as the elastic layer can be spirally wound around the core in a non-overlapping manner.

In the elastic layer 104, the elastic member 108 (strip 108) is spirally wound with an angle θ (spiral angle θ) of from 2° to 75°, more preferably from 4° to 75°, and still more preferably from 8° to 45° with respect to an axial direction of the core 102.

Here, as shown in FIG. 2, the spiral angle θ refers to an angle (acute angle) at which the longitudinal direction P of the elastic layer 104 (spiral direction) intersects with the axial direction Q of the cleaning member (the axial direction of the core).

By adjusting the spiral angle θ to be 2° or more, the elastic layer is not likely to receive resistance during the contact with the cleaning object, and the peeling of the end of the elastic layer in the longitudinal direction is likely to be prevented. In addition, by adjusting the spiral angle θ to be 2° or more, the winding number of the strip 108 is likely to be at least 1 even when the length of the core is not increased, and the size of the cleaning member is likely to be reduced.

On the other hand, by adjusting the spiral angle θ to be 75° or less, the restoring force of the elastic layer corresponding to the curvature of the core is likely to be decreased, and the peeling of the end of the elastic layer in the longitudinal direction is not likely to occur.

A thickness D of the elastic layer 104 (thickness thereof at the center in the width direction) is preferably from 1.0 nm to 15.0 mm, more preferably from 1.5 mm to 15 mm, and still more preferably from 2 mm to 5 mm. By adjusting the thickness D of the elastic layer 104 to be from 1.0 mm to 15.0 mm, the adhesive force with the core 102 is likely to be secured when the cleaning member 100 is rotated together with the cleaning object, and the peeling of the end of the elastic layer in the longitudinal direction from the core 102 is not likely to occur. Further, there are advantageous effects in reducing the size of the cleaning member 100.

When the cleaning member 100 is rotated together with the cleaning object, the winding number of the elastic layer 104 around the core 102 is preferably 1 or more, more preferably 1.3 or more, and still more preferably 2 or more. By adjusting the winding number of the elastic layer 104 around the core 102 to be 1 or more, rotation failure is not likely to occur. When the cleaning member 100 is rotated together with the cleaning object, the upper limit of the winding number of the elastic layer 104 is not particularly limited because it varies depending on the length of the core on which the cleaning function works.

In addition, when a separate rotation mechanism is provided for the cleaning member independently of the cleaning object without rotating the cleaning member 100 together with the cleaning object, the winding number of the elastic layer 104 is not particularly limited.

In the elastic layer 104, the coverage (Spiral Width W1 of Elastic Layer 104/[Spiral Width W1 of Elastic Layer 104+ Spiral Pitch W2 of Elastic Layer 104], i.e, W1/(W1+W2)) is from 8% to 80% and preferably from 10% to 70%.

As shown in FIG. 2, the spiral pitch W2 refers to the distance between adjacent portions of the elastic layer 104 along the axial direction Q (core axial direction) of the cleaning member 100 of the elastic layer 104.

For example, the thickness D of the elastic layer 104 is measured as follows.

In a state where the peripheral direction of the cleaning member is fixed, the cleaning member is scanned using a laser measuring device (a laser scan micrometer manufactured by Mitutoyo Corporation, Model No: LSM 6200) in the longitudinal direction (axial direction) of the cleaning member at a traverse speed of 1 mm/s to measure the profile of the thickness of the elastic layer. Next, the same measurement is performed after the position in the peripheral direction is changed (three positions in the peripheral direction at an interval of 120°). Based on this profile, the thickness D of the elastic layer 104 is calculated.

Figure 4:
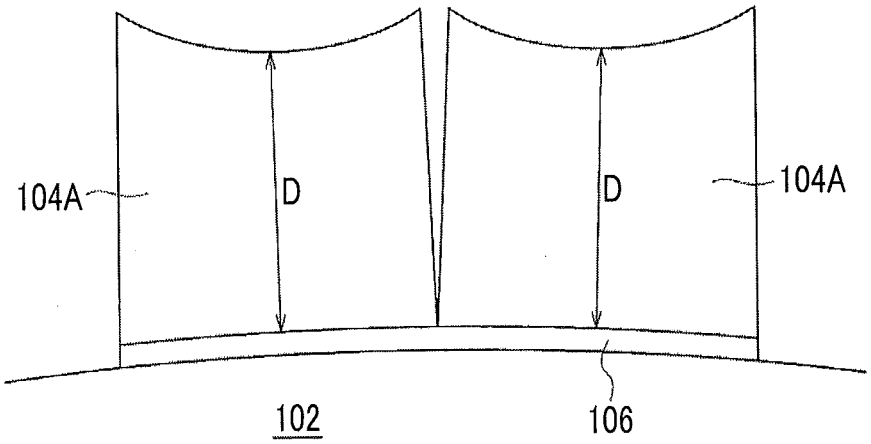
FIG. 4 is an enlarged cross-sectional view showing an elastic layer in a cleaning member according to another exemplary embodiment.
Figure 5:
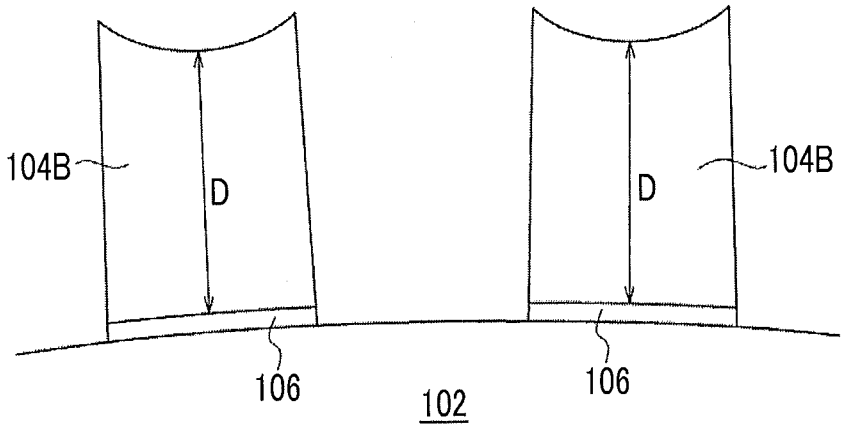
FIG. 5 is an enlarged cross-sectional view showing an elastic layer in the cleaning member according to the other exemplary embodiment.

Here, the elastic layer 104 is not limited to the configuration of being formed of the single strip 108. As shown in FIGS. 4 and 5, for example, instead of the elastic layer 104, elastic layers 104A or 104B may be adopted which are formed of at least two or more strips 108 (strip-shaped elastic members), in which the two or more strips 108 are spirally wound around the core 102. When the two or more strips 108 are spirally wound around the core 102 to form the elastic layers 104A or 104B, the cleaning performance of the cleaning member 100 is likely to be improved.

As the winding number of the strip 108 increases, an effect of improving the cleaning performance is proportionally obtained. During the winding of the two or more strips 108, the spiral width W1 of at least one of the elastic layers 104 is less than or equal to a radius R of the core 102 and is 1 mm or more.

In addition, the elastic layers in which the two or more strips 108 (strip-shaped elastic members) are wound around the core 102 may be the elastic layers 104A (refer to FIG. 4) in which the two strips 108 are spirally wound in a state where sides of adhesive surfaces of the strips 108 (surfaces of the strips 108 opposite to the outer peripheral surface of the core 102) in the longitudinal direction contact each other, or may be the elastic layers 104B (refer to FIG. 5) in which the two strips 108 are spirally wound in a state where the sides of the adhesive surfaces do not contact each other.

In particular, for example, when the elastic layers are the elastic layers 104A (refer to FIG. 4) in which the two strips 108 are spirally wound in a state where the sides of the adhesive surfaces of the strips 108 in the longitudinal direction contact each other, it is considered that a higher contact pressure is applied to the cleaning object, and higher cleaning performance is likely to be obtained as compared to a case where one elastic member is used with the same spiral width W1 (FIG. 3).

Next, the adhesive layer 106 will be described.

The adhesive layer 106 is not particularly limited as long as it can bond the core 102 and the elastic layer 104 to each other. For example, the adhesive layer 106 is formed of a double-sided tape or other adhesives.

Next, a method of manufacturing the cleaning member 100 according to the exemplary embodiment will be described.

Figure 6A:
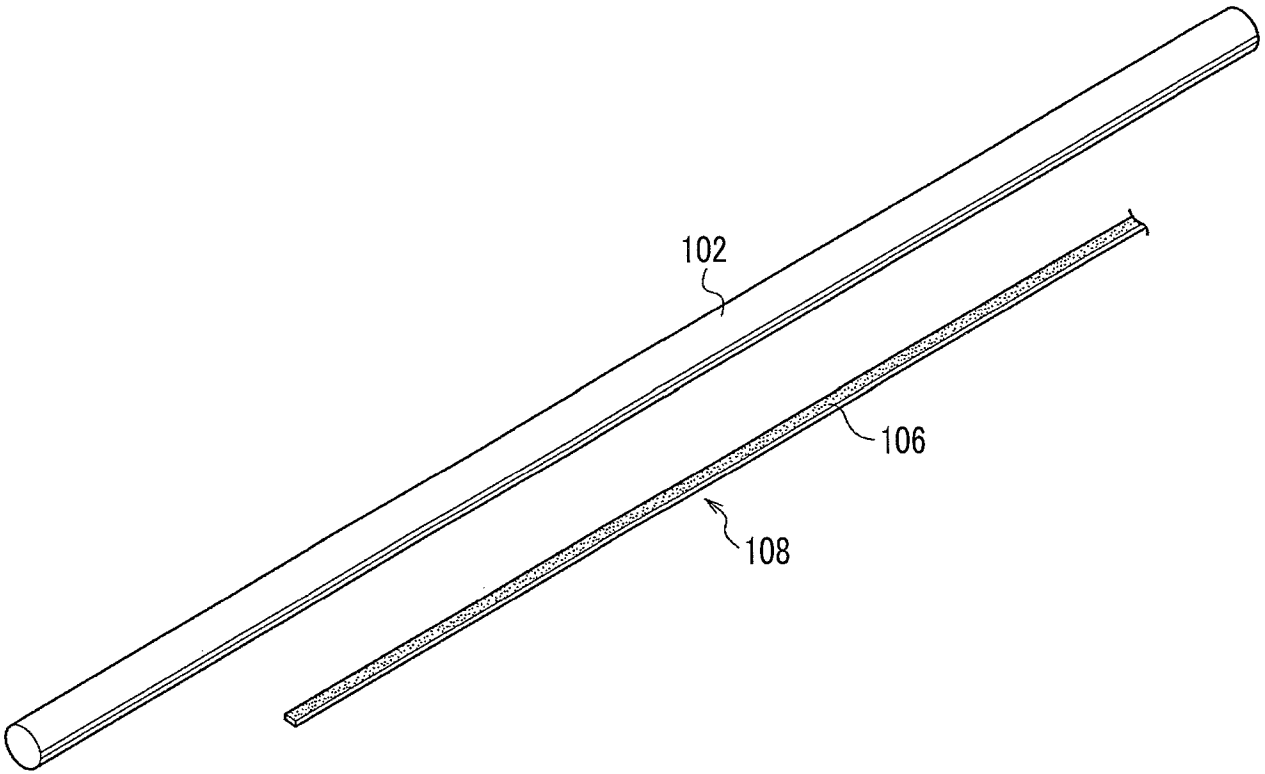
FIG. 6A is a process drawing showing an example of a method of manufacturing a cleaning member according to an exemplary embodiment.
Figure 6B:
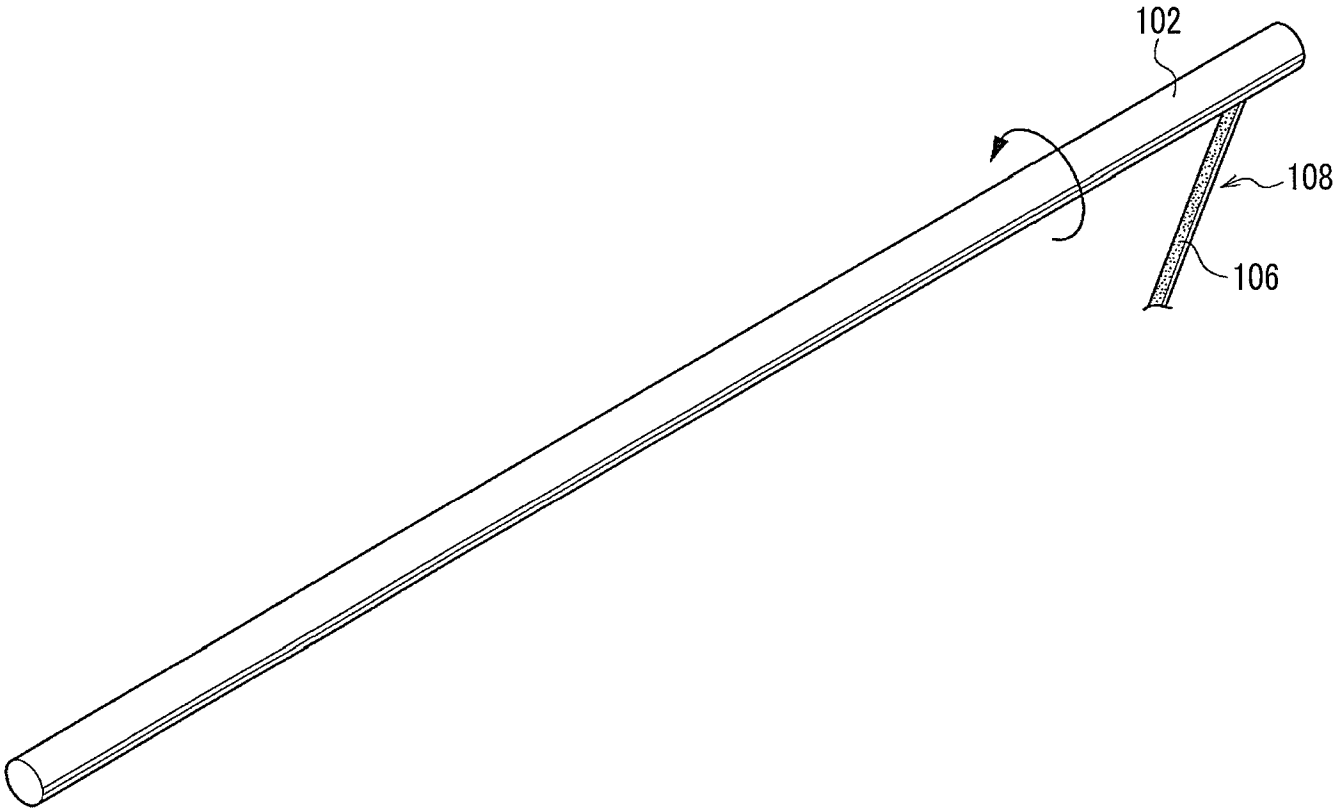
FIG. 6B is a process drawing showing the example of the method of manufacturing a cleaning member according to the exemplary embodiment.
Figure 6C:
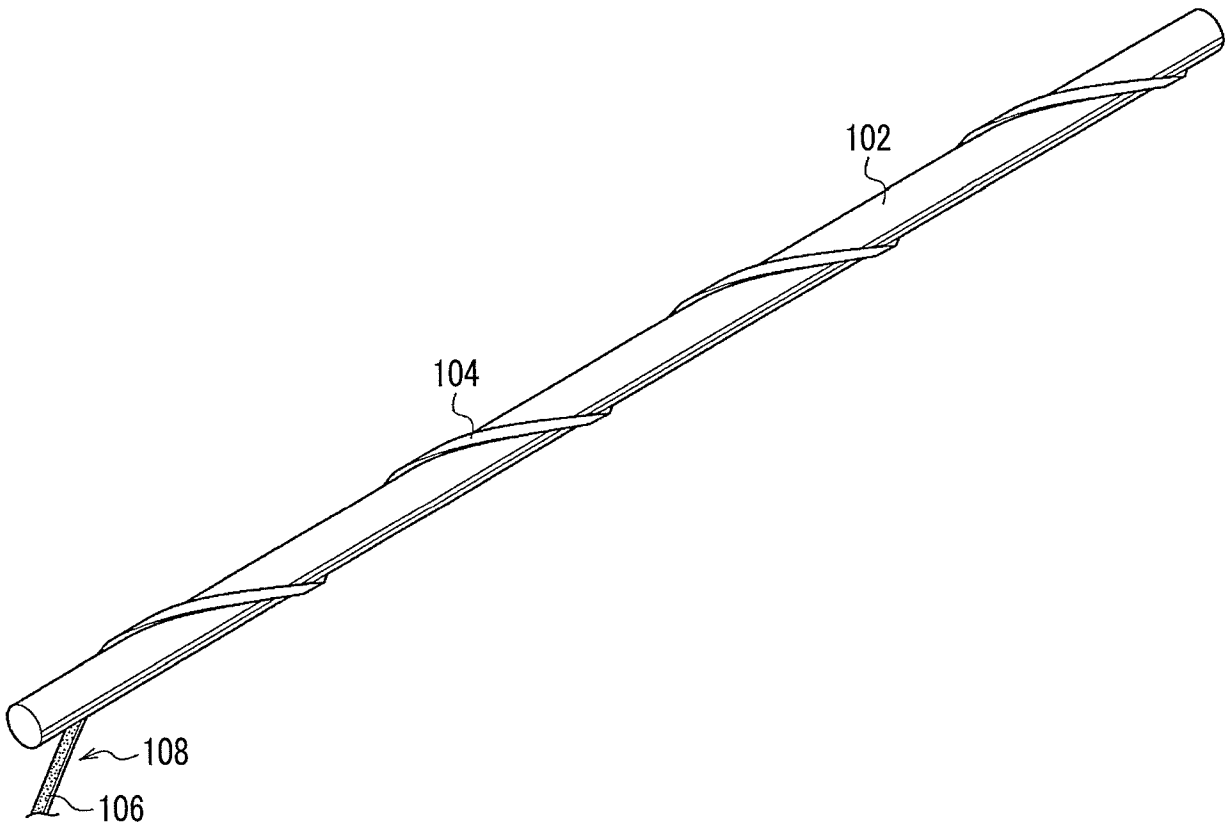
FIG. 6C is a process drawing showing the example of the method of manufacturing a cleaning member according to the exemplary embodiment.

FIGS. 6A to 6C are process drawings showing an example of the method of manufacturing the cleaning member 100 according to the exemplary embodiment.

First, as shown in FIG. 6A, a sheet-shaped elastic member (for example, a polyurethane foam sheet) having a target thickness is prepared by slicing, and the elastic member is punched using a punch die to obtain a sheet having a target width and a target length.

A double-sided tape as the adhesive layer 106 (hereinafter, also referred to as "double-sided tape 106) is bonded to a single surface of the sheet-shaped elastic member to obtain a strip 108 having a target width and a target length (strip-shaped elastic member to which the double-sided tape 106 is bonded).

Next, as shown in FIG. 6B, the strip 108 is disposed such that a surface thereof to which the double-sided tape 106 is bonded faces upward. In this state, one end of release paper of the double-sided tape is peeled off, and one end of the core 102 is placed on a portion of the double-sided tape 106 from which the release paper is peeled off.

Next, as shown in FIG. 6C, by rotating the core 102 at a target speed while peeling off the release paper of the double-sided tape, the strip 108 is spirally wound around the outer peripheral surface of the core 102. As a result, the cleaning member 100 including the elastic layer 104 which is spirally wound around the outer peripheral surface of the core 102 is obtained.

In the exemplary embodiment, from the viewpoints of decreasing the restoring force of the strip 108 and decreasing the peeling of the end of the strip 108 in the longitudinal direction from the core 102, it is preferable that the strip 108 is wound around the core 102 in a state where the degree of elastic deformation (change in the thickness at the center in the width direction) of the strip 108 is low. Specifically, it is preferable that the angle and the tension during the winding of the strip 108 are controlled according to the thickness of the strip 108.

Here, when the strip 108 which forms the elastic layer 104 is wound around the core 102, the position of the strip 108 is aligned with the core 102 such that the longitudinal direction of the strip 108 forms a target angle (spiral angle) with the axial direction of the core 102. In addition, for example, the outer diameter of the core 102 is preferably from ϕ2 mm to ϕ12 mm.

When the strip 108 is wound around the core 102, it is preferable that tension is applied to the extent that a gap is not formed between the core 102 and the double-sided tape 106 of the strip 108. When excessive tension is applied, it is difficult to decrease the restoring force of the strip 108. In addition, tension set increases, and the elastic force of the elastic layer 104 required for cleaning tends to decrease. Specifically, for example, it is preferable that tension is applied such that the elongation is from 0% to 5% with respect to the original length of the strip 108.

On the other hand, when the strip 108 is wound around the core 102, the strip 108 tends to be elongated. This elongation varies in the thickness D direction of the strip 108. The outermost surface of the strip 108 tends to be elongated, and the elastic force thereof may decrease. Therefore, it is preferable that the elongation of the outermost surface of the strip 108 after being wound around the core 102 is about 5% with respect to the original length of the outermost surface of the strip 108.

This elongation is controlled by the curvature radius of the strip 108 being wound around the core 102; and the thickness of the strip 108. The curvature radius of the strip 108 being wound around the core 102 is controlled by the outer diameter of the core 102 and the winding angle (spiral angle θ) of the strip 108.

For example, the curvature radius of the strip 108 being wound around the core 102 is preferably from ((Core Outer Diameter/2)+1 mm) to ((Core Outer Diameter/2)+15 mm) and more preferably from ((Core Outer Diameter/2)+1.5 mm) to ((Core Outer Diameter/2)+5.0 mm).

In the exemplary embodiment, the width W1 of the strip 108 is adjusted to be less than or equal to the radius R of the core 102 and to be 1 mm or more. In addition, the length of the strip 108 is determined based on, for example, the length of the region thereof wound around the core 102 in the axial direction, the winding angle (spiral angle θ), and the tension during the winding.

(Image Forming Apparatus and Other Components)

Hereinafter, an image forming apparatus according to an exemplary embodiment will be described based on the drawings.

Figure 7:
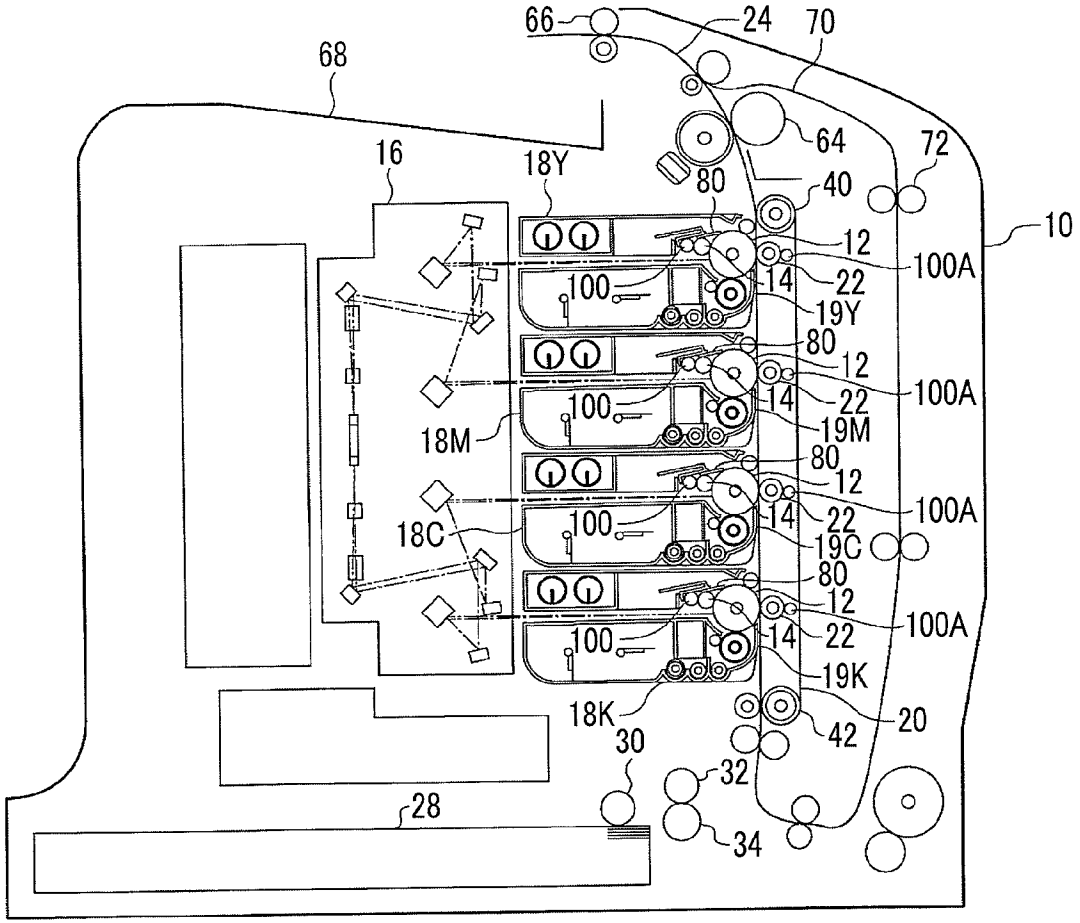
FIG. 7 is a diagram schematically showing a configuration of an image forming apparatus according to an exemplary embodiment.

FIG. 7 is a diagram schematically showing a configuration of the image forming apparatus according to the exemplary embodiment.

Figure 8:
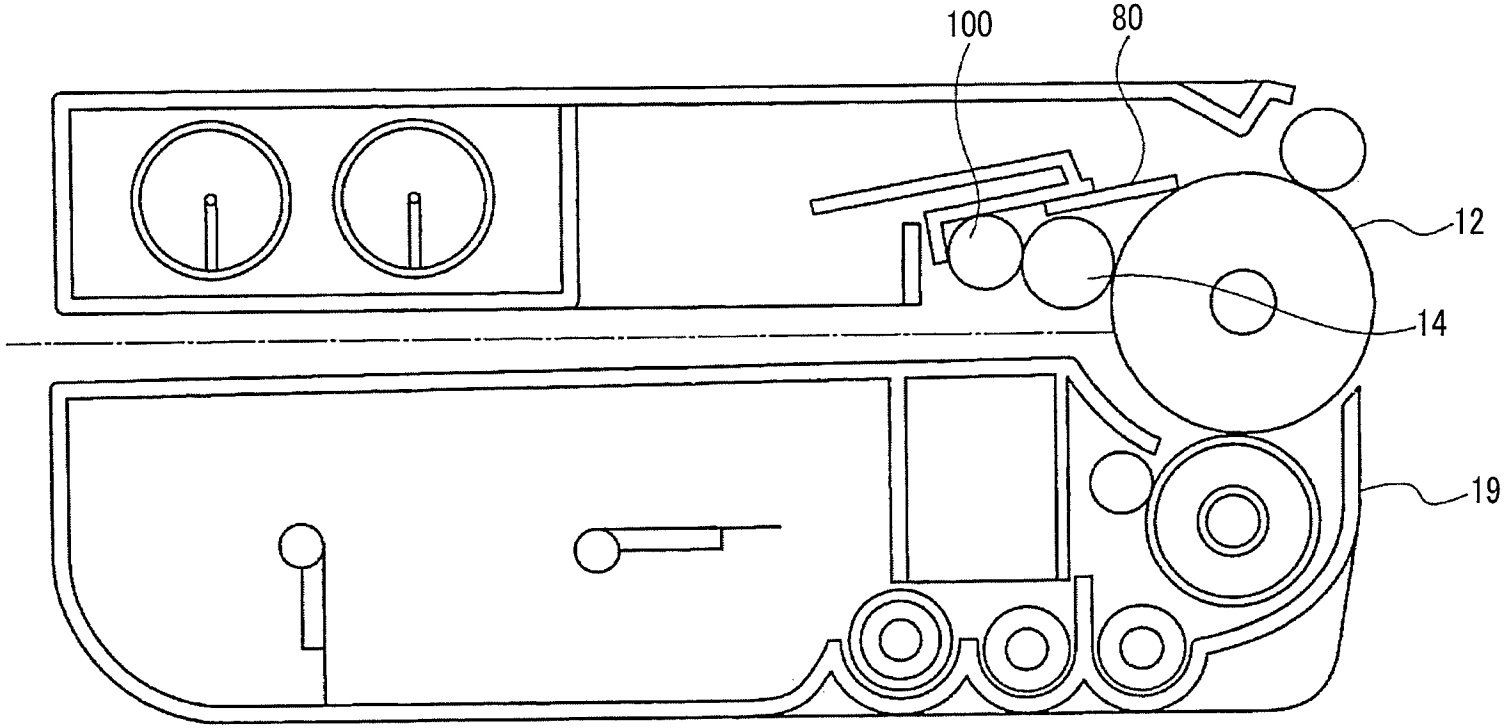
FIG. 8 is a diagram schematically showing a configuration of a process cartridge according to an exemplary embodiment.

As shown in FIG. 7, the image forming apparatus 10 according to the exemplary embodiment is, for example, a tandem-type color image forming apparatus. In the image forming apparatus 10 according to the exemplary embodiment, a photoreceptor (image holding member) 12, a charging member 14, a developing device, and the like are provided as a process cartridge (refer to FIG. 8) for each color of yellow (18Y), magenta (18M), cyan (18C), and black (18K). This process cartridge is detachable from the image forming apparatus 10.

As the photoreceptor 12, a conductive cylindrical member having a diameter of 25 mm is used, whose surface is coated with a photoreceptor layer formed of an organic photosensitive material. The photoreceptor 12 is rotated by a motor (not shown) at a process speed of, for example, 150 mm/sec.

The surface of the photoreceptor 12 is charged by the charging member 14 disposed on the surface of the photoreceptor 12. Next, on a downstream side of the charging member 14 in a rotating direction of the photoreceptor 12, the surface of the photoreceptor 12 is exposed to laser beams LB, emitted from an exposure device 16, based on image information. As a result, an electrostatic latent image corresponding to the image information is formed on the surface of the photoreceptor 12.

The electrostatic latent image formed on the photoreceptor 12 is developed by developing devices 19Y, 19M, 19C, and 19K of the respective colors including yellow (Y), magenta (M), cyan (C), and black (K). As a result, respective color toner images are formed.

For example, when a color image is formed, the charging, exposure, and developing processes corresponding to the respective colors including yellow (Y), magenta (M), cyan (C), and black (K) are performed on the surfaces of the photoreceptors 12 for the respective colors. As a result, toner images corresponding to the respective colors including yellow (Y), magenta (M), cyan (C), and black (K) are formed on the surfaces of the photoreceptors 12 for the respective colors.

The toner images of the respective color including yellow (Y), magenta (M), cyan (C), and black (K) which are sequentially formed on the photoreceptor 12 are, at a contact position between the photoreceptor 12 and a transfer member 22, transferred onto recording sheet 24 through a sheet feed belt 20 which is applied with tension by support rollers 40 and 42 and concurrently supported from an inner peripheral surface thereof, the recording sheet being fed to the outer periphery of the photoreceptor 12 along the sheet feed belt 20. Further, the recording sheet 24 onto which the toner images are transferred from the photoreceptor 12 is fed to a fixing device 64 and is heated and pressurized by the fixing device 64. As a result, the toner images are fixed to the recording sheet 24. Next, in the case of single-sided printing, the recording sheet 24 on which the toner images are fixed is discharged as it is onto an exit port 68 by a discharge roller 66, the exit port 68 being provided in an upper section of the image forming apparatus 10.

The recording sheet 24 is taken out from a sheet container 28 by a take-out roller 30 and is fed to the sheet feed belt 20 by feed rollers 32 and 34.

On the other hand, in the case of double-sided printing, the recording sheet 24 having a first surface (front surface) on which the toner images are fixed by the fixing device 64 is not discharged onto the exit port 68 by the discharge roller 66, and a rear end of the recording sheet 24 is nipped by the discharge roller 66. In this state, the discharge roller 66 is reversed, and a feeding path of the recording sheet 24 is switched to a sheet feeding path 70 for double-sided printing. The recording sheet 24 is turned inside out by a feed roller 72 disposed in the sheet feeding path 70 for double-sided printing. In this state, the recording sheet 24 is fed again to the sheet feed belt 20, and toner images are transferred onto a second surface (back surface) of the recording sheet 24 from the photoreceptor 12. The toner images on the second surface (back surface) of the recording sheet 24 are fixed by the fixing device 64, and then the recording sheet 24 (transfer medium) is discharged onto the exit port 68.

After completion of the toner image transfer process, whenever the photoreceptor 12 is rotated once, toner, paper powder, and the like remaining on the surface of the photoreceptor 12 are removed by a cleaning blade 80 which is disposed on the surface of the photoreceptor 12 on a downstream side of a contact portion with the transfer member 22 in the rotating direction of the photoreceptor 12. As a result, the photoreceptor 12 is ready for the next image forming step.

Here, as shown in FIG. 7, the transfer member 22 is, for example, a roller in which a conductive elastic layer (not shown) is formed around a conductive core (not shown), and the conductive core is rotatably supported. On a side of the transfer member 22 opposite to the photoreceptor 12, a cleaning member 100A is disposed in contact with the transfer member 22. That is, the transfer member 22 and the cleaning member 100A form a transfer device (unit). As the cleaning member 100A, the cleaning member 100 (refer to FIG. 1) according to the exemplary embodiment is used.

Here, a method of causing the cleaning member 100A to be rotated together with the transfer member 22 continuously in contact with the transfer member 22 will be described. However, the cleaning member 100A may be rotated continuously in contact with the transfer member 22, or may be rotated in contact with the transfer member 22 only during the cleaning of the transfer member 22. In addition, the cleaning member 100A may contact the transfer member 22 only during the cleaning of the transfer member 22, and a separate driving mechanism may be provided to create a difference in peripheral speed between the cleaning member 100A and the transfer member 22. However, it is not preferable that a method of causing the cleaning member 100A to continuously contact the transfer member 22 and to create a difference in peripheral speed therebetween is used because dirt on the transfer member 22 accumulates on the cleaning member 100A and is likely to be attached to the transfer member 22 again.

Figure 9:
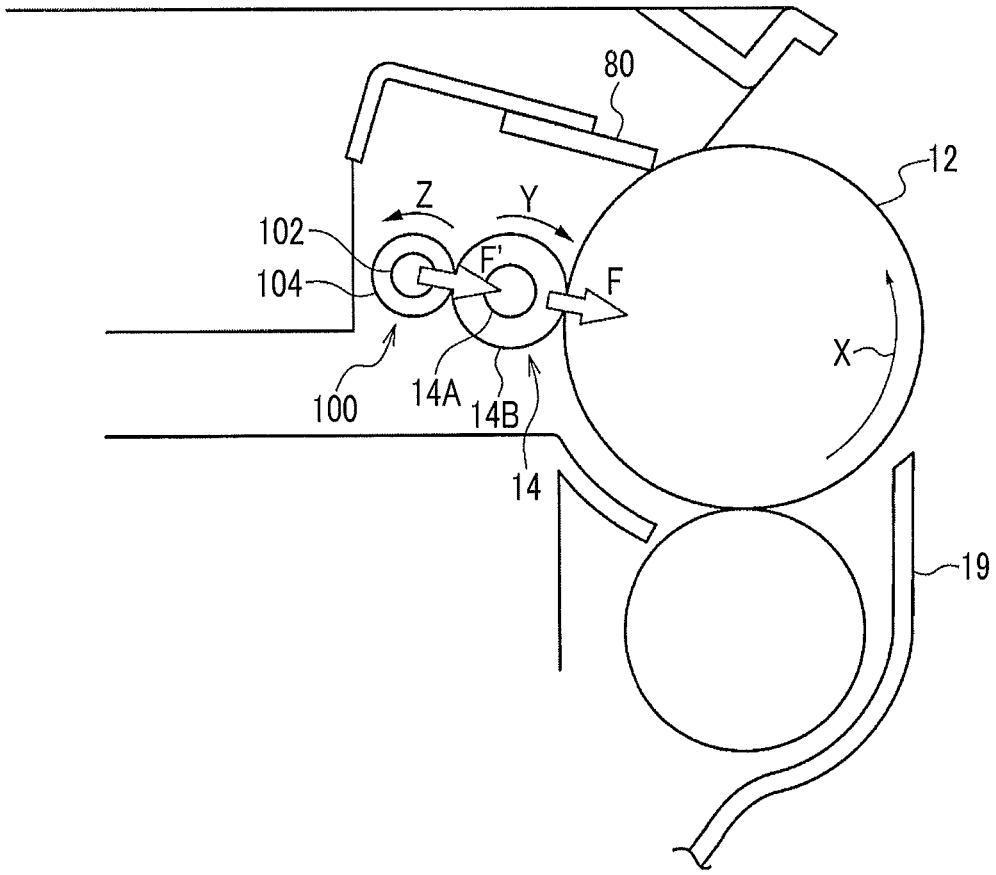
FIG. 9 is an enlarged diagram schematically showing a configuration of a peripheral portion of a charging member (charging device) shown in FIGS. 7 and 8.

On the other hand, as shown in FIG. 9, the charging member 14 is, for example, a roller in which a foaming elastic layer 14B is formed around a conductive core 14A, and the conductive core 14A is rotatably supported. On a side of the charging member 14 opposite to the photoreceptor 12, the cleaning member 100 is disposed in contact with the charging member 14 to form a charging device (unit). As the cleaning member 100, the cleaning member according to the exemplary embodiment is used.

Here, a method of causing the cleaning member 100 to be rotated together with the charging member 14 continuously in contact with the charging member 14 will be described. However, the cleaning member 100 may be rotated continuously in contact with the charging member 14, or may be rotated in contact with the charging member 14 only during the cleaning of the charging member 14. In addition, the cleaning member 100 may contact the charging member 14 only during the cleaning of the charging member 14, and a separate driving mechanism may be provided to create a difference in peripheral speed between the cleaning member 100 and the charging member 14. However, it is not preferable that a method of causing the cleaning member 100 to continuously contact the charging member 14 and to create a difference in peripheral speed therebetween is used because dirt on the charging member 14 accumulates on the cleaning member 100 and is likely to be attached to the charging member 14 again.

The charging member 14 applies a load F to both ends of the conductive core 14A to be pressed against the photoreceptor 12 and is elastically deformed along the peripheral surface of the foaming elastic layer 14B to form a nip portion. Further, the cleaning member 100 applies a load F' to both ends of the core 102 to be pressed against the charging member 14, and the elastic layer 104 is elastically deformed along the peripheral surface of the charging member 14 to form a nip portion. As a result, the deflection of the charging member 14 is decreased, and a nip portion is formed between the charging member 14 and the photoreceptor 12 in the axial direction.

The photoreceptor 12 is rotated by a motor (not shown) in a direction indicated by arrow X. Due to the rotation of the photoreceptor 12, the charging member 14 is rotated in a direction indicated by arrow Y. In addition, due to the rotation of the charging member 14, the cleaning member 100 is rotated in a direction indicated by arrow Z.

Configuration of Charging Member

Hereinafter, the charging member will be described but is not limited to the following configuration.

The configuration of the charging member is not particularly limited. For example, a configuration including the core and the foaming elastic layer (or a resin layer instead of the foaming elastic layer) may be adopted. The foaming elastic layer may have a single-layer configuration or a laminated configuration in which plural different layers having several functions are laminated. Further, the foaming elastic layer may be surface-treated.

As a material of the core, for example, free-cutting steel or stainless steel is used. It is preferable that the material and surface treatment method are appropriately selected according to the use such as sliding properties. In addition, it is preferable that the material is plated. In addition, when the core is formed of a non-conductive material, the non-conductive material may be used as it is or may be treated to be conductive through a general treatment such as plating.

The foaming elastic layer is a conductive foaming elastic layer. For example, materials which can be usually added to rubber may be added to the conductive foaming elastic layer, the materials including: an elastic material such as elastic rubber; a conductive material such as carbon black or an ion conductive material for adjusting the resistance of the conductive foaming elastic layer; and, optionally, a softener, a plasticizer, a curing agent, a vulcanizing agent, a vulcanizing accelerator, an age inhibitor, or a filler such as silica or calcium carbonate. The conductive foaming elastic layer is formed by coating the peripheral surface of the conductive core with the mixture to which the materials usually added to rubber are added. As the conductive material for adjusting the resistance value, a dispersion of an electrically conductive material using at least either electrons or ions as charge carriers, for example, carbon black or a ion conductive material, which may be blended in a matrix, may be used. In addition, the elastic material may be a foam.

The elastic material constituting the conductive foaming elastic layer is formed, for example, by dispersing a conductive material in a rubber material. Preferable examples of the rubber material include silicone rubber, ethylene propylene rubber, epichlorohydrin-ethylene oxide copolymer rubber, epichlorohydrin-ethylene oxide-allyl glycidyl ether copolymer rubber, acrylonitrile-butadiene copolymer rubber, and a blend rubber thereof. These rubber materials may be foaming or non-foaming.

As the conductive material, an electron conductive material or an ion conductive material is used. Examples of the electron conductive material include fine powders of the following materials including: carbon black such as ketjen black or acetylene black; pyrolytic carbon and graphite; various conductive metals and alloys thereof such as aluminum, copper, nickel, and stainless steel; various conductive metal oxides such as tin oxide, indium oxide, titanium oxide, tin oxide-antimony oxide solid solution, and tin oxide-indium oxide solid solution; and materials obtained by treating a surface of an insulating material to be conductive. In addition, examples of the ion conductive material include perchlorates, chlorate, and the like of oniums such as tetraethylammonium and lauryl trimethyl ammonium; and perchlorates, chlorate, and the like of alkali metals and alkali earth metals such as lithium and magnesium.

Among these conductive materials, one kind may be used alone, or two or more kinds may be used in combination. In addition, the addition amount is not particularly limited. The addition amount of the electron conductive material is preferably from 1 part by weight to 60 parts by weight with respect to 100 parts by weight of the rubber material. On the other hand, the addition amount of the ion conductive material is preferably from 0.1 parts by weight to 5.0 parts by weight with respect to 100 parts by weight of the rubber material.

A surface layer may be formed on the surface of the charging member. As a material of the surface layer, any one of a resin, a rubber, and the like may be used without any particular limitation. Preferable examples of the material of the surface layer include polyvinylidene fluoride, tetrafluoroethylene copolymers, polyester, polyimide, and copolyamide.

The copolyamide includes one or plural 610 nylon, 11 nylon, and 12 nylon as a polymerizable unit, and includes 6 nylon, nylon, 66 nylon, and the like as another polymerizable unit. Here, a total ratio of the polymerizable unit such as 610 nylon, 11 nylon, and 12 nylon to the copolymer is preferably 10% or higher by weight ratio.

Among polymer materials, one kind may be used alone, or a mixture of two or more kinds may be used. The number average molecular weight of the polymer material is preferably from 1,000 to 100,000 and more preferably from 10,000 to 50,000.

In addition, the surface layer may contain a conductive material to adjust the resistance value. The particle diameter of the conductive material is preferably 3 μm or less.

As the conductive material for adjusting the resistance value, a dispersion of an electrically conductive material using at least either electrons or ions as charge carriers, for example, carbon black, conductive metal oxide particles, or a ion conductive material, which may be blended in a matrix, may be used.

Specific examples of the conductive carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", AND "COLOR BLACK FW2V", all of which are manufactured by Evonik Degussa Japan Co., Ltd.; and "MONARCH 1000", "MONARCH 1300", "MONARCH 1400", "MOGUL-L", and "REGAL 400R", all of which are manufactured by Cabot Corporation.

The pH of the carbon black is preferably 4.0 or lower.

The conductive metal oxide particles which are conductive particles for adjusting the resistance value are not particularly limited as long as they are conductive particles using electrons as charge carriers, for example, tin oxide, antimony-doped tin oxide, zinc oxide, anatase-type titanium oxide, and ITO. Among these, one kind may be used alone, or two or more kinds may be used in combination. In addition, although the conductive metal oxide particles are not limited in particle diameter, tin oxide, antimony-doped tin oxide, or anatase-type titanium oxide is preferable, and tin oxide or antimony-doped tin oxide is more preferable.

Further, a fluorine-based resin or a silicone-based resin is preferably used for the surface layer. In particular, it is preferable that the surface layer is formed of a fluorine-modified acrylate polymer. In addition, particles may be added to the surface layer. In addition, insulating particles such as alumina or silica may be added to the surface layer such that concave portions are provided on the surface of the charging member to reduce burden when being rubbed against the photoreceptor and to thereby improve wear resistance between the charging member and the photoreceptor.

The outer diameter of the charging member described herein is preferably from 8 mm to 16 mm. In addition, the outer diameter is measured using a commercially available vernier caliper, or laser type outer diameter measuring device.

The micro hardness of the charging member described herein is preferably from 45° to 60°. As a method of reducing the hardness, for example, a method of increasing the addition amount of a plasticizer or a method of using a low-hardness material such as silicone rubber can be adopted.

In addition, the micro hardness of the charging member can be measured using a MD-1 hardness meter (manufactured by Kobunshi Keiki Co., Ltd.).

In the above description of the image forming apparatus according to the exemplary embodiment, the process cartridge includes the photoreceptor (image holding member), the charging device (unit including the charging member and the cleaning member), the developing device, and the cleaning blade (cleaning device). However, the process cartridge is not limited to the above-described configuration. The process cartridge may include the charging device (unit including the charging member and the cleaning member) and optionally, may further include one component selected from the photoreceptor (image holding member), the exposure device, the transfer device, the developing device, and the cleaning blade (cleaning device). The process cartridge may include the transfer device (unit including the transfer member and the cleaning member) and optionally may further include one component selected from the photoreceptor (image holding member), the exposure device, the charging device, the developing device, and the cleaning blade (cleaning device). The above devices and members may be directly disposed in the image forming apparatus without being combined into a cartridge.

In addition, in the above description of image forming apparatus according to the exemplary embodiment, the charging device is configured as the unit including the charging member and the cleaning member, and the transfer device is configured as the unit including the transfer member and the cleaning member. That is, the charging member is used as the cleaning object, and the transfer member is used as the cleaning object. However, the exemplary embodiment is not limited to the above-described configurations. Examples of the cleaning object include the photoreceptor (image holding member), the transfer device (transfer feed belt; sheet feed belt), an intermediate transfer type secondary transfer device (secondary transfer member; secondary transfer roller), and an intermediate transfer medium (intermediate transfer belt). A unit including the above cleaning object and the cleaning member contacting the cleaning object may be directly disposed in the image forming apparatus. Alternatively, as described above, the unit may be formed into a cartridge such as a process cartridge may be disposed in the image forming apparatus.

In addition, the image forming apparatus according to the exemplary embodiment is not limited to the above-described configuration, and a well-known image forming apparatus such as an intermediate transfer type image forming apparatus may be adopted.

EXAMPLES

Hereinafter, the invention will be described in more detail using Examples but is not limited to these examples.

Example 1

Preparation of Cleaning Roller 1

In order to prepare an elastic member, a urethane foam (EP-70; manufactured by INOAC Corporation) sheet is cut into a strip. A double-sided tape (No. 5605 manufactured by Nitto Denko Corporation) having a thickness of 0.05 mm is bonded to the cut strip such that the center portions thereof in the width direction match each other. As a result, a double-sided tape-bonded strip is obtained. The obtained double-sided tape-bonded strip is placed on a flat table such that release tape attached to the double-sided tape faces below. Tension is applied to a metal core (total length: 200 mm, core radius: 6 mm) obtained by plating free-cutting steel with nickel such that the total length of the strip is elongated by from 0% to 5%, and concurrently the strip is wound around a region of the metal core ranging from one end to another end thereof with a spiral angle of 45° (that is, an elastic layer is provided in a range of 180 mm) such that both ends of the metal core having a size of 10 mm are exposed. As a result, a cleaning roller 1 (cleaning member) in which the spirally disposed elastic layer is formed is obtained. The width W1 of the elastic layer, the thickness D of the elastic layer, and the winding number are shown in Table 2.

The width of the urethane foam sheet and the width of the double-sided tape are shown as the lengths along a direction perpendicular to the longitudinal direction thereof.

Examples 2 to 8 and 10 to 13

Preparation of Cleaning Rollers 2 to 8 and 10 to 13

Cleaning rollers 2 to 8 and 10 to 13 are obtained by the same procedure as that of the cleaning roller 1, except that the core radius R, the spiral angle θ, the width W1 of the elastic layer, the thickness D of the elastic layer, and the winding number are changed as shown in Table 2.

Example 9

Preparation of Cleaning Roller 9

A cleaning roller 9 is obtained by the same procedure as that of the cleaning roller 1, except that a melamine foam (BASOTECT W, manufactured by BASF AG) sheet is used as the elastic member; and the core radius R, the spiral angle θ, the width W1 of the elastic layer, the thickness D of the elastic layer, and the winding number are changed as shown in Table 2.

Comparative Examples 1 to 6

Preparation of Comparative Cleaning Rollers 1 to 6

Comparative cleaning rollers 1 to 6 are obtained by the same procedure as that of the cleaning roller 1, except that the core radius R, the spiral angle θ, the width W1 of the elastic layer, the thickness D of the elastic layer, and the winding number are changed as shown in Table 3.

[Evaluation]

Using the cleaning roller prepared in each example, the peeling of the end of the elastic layer in the longitudinal direction and the followability are evaluated. In the evaluation of the followability, the following charging roller is used.

Preparation of Charging Roller

Formation of Elastic Roller

A mixture shown in Table 1 is kneaded with an open roller. Then, using a press forming machine, a conductive elastic layer having an outer diameter of 10 mm and a length of 180 mm is formed on a surface of a core formed of SUS 303 having a diameter of 6 mm and a total length of 200 mm with an adhesive layer interposed therebetween. Next, the outer diameter of the roller is adjusted to 9.0 mm by polishing, and thus an elastic roller including the conductive elastic layer is obtained.

Formation of Surface Layer

A dispersion obtained by dispersing the following mixture using a bead mill is diluted with methanol, and the surface of the conductive elastic layer is dip-coated with the diluted dispersion and is heated and dried at 140° C. for 15 minutes. As a result, a surface layer having a thickness of 4 μm is formed to thereby obtain a charging roller.

Polymer material: 100 parts by weight
(copolyamide, AMILAN CM8000; manufactured by Toray Industries, Inc.)

Conductive material: 30 parts by weight
(antimony-doped tin oxide, SN-100P; manufactured by Ishihara Sangyo Kaisha, Ltd.)

Solvent (methanol): 500 parts by weight

Solvent (butanol): 240 parts by weight

TABLE 1

| | Material | Mixing Ratio (part(s) by weight) |
|---|---|---|
| Rubber | Epichlorohydrin Rubber (HYDRIN T3106/Zeon Corporation) | 100 |
| Conductive Material | Carbon Black (#55/Asahi Carbon Co., Ltd.) | 20 |
| | Benzyl Triethyl Ammonium Chloride (Kanto Chemical Co., Inc.) | 1 |
| Vulcanizing Agent | Sulfur (SULFAX PS/Tsurumi Chemical Industry Co., Ltd.) | 0.5 |
| Vulcanizing Accelerator | Tetramethyl Lithium Disulfide (NOCCELER TT/Ouchi Shinko Chemical Industrial Co., Ltd.) | 1.5 |
| | Dibenzothiazole Disulfide (NOCCELER DM/Ouchi Shinko Chemical Industrial Co., Ltd.) | 1.5 |
| Vulcanizing Accelerating Auxiliary Agent | Zinc Oxide (Zinc Oxide Type 1/ Seido Chemical Industry Co., Ltd.) | 5 |
| Filler | Calcium Carbonate (SILVER W/ Shiraishi Calcium Co., Ltd.) | 20 |
| Lubricant | Stearic Acid (Kanto Chemical Co., Inc.) | 1 |

Peeling Evaluation

Peeling Evaluation after Storage

In the peeling evaluation after storage, the cleaning roller prepared in each example is stored in a environment of 45° C./95% RH for 30 days and then is stored in a environment of 10° C./15% RH for 30 days using a jig capable of holding both ends of the core such that the elastic layer does not contact anything. Next, whether or not the peeling of the end of the elastic layer in the longitudinal direction occurs in the cleaning roller is determined. The determination of the peeling is made by visual inspection according to the following criteria. The results are shown in Tables 2 and 3.

Peeling Evaluation: Criteria

G1: No peeling is observed

G2: An extremely small amount of peeling causing no problem in practice is observed at a corner of one end or both ends in the longitudinal direction G3: Peeling causing a problem in practice (a state where one end or both ends in the longitudinal direction are peeled off from the metal core by 0.3 mm or more) is observed at a corner of one end or both ends in the longitudinal direction Peeling Evaluation based on Rotation After completion of the storage of the cleaning roller, the cleaning roller prepared in each example which is evaluated to be higher than G3 (G1 or G2) in the peeling evaluation is mounted on a device in which the cleaning roller is caused to bite into the charging roller prepared in each example by 0.5 mm and the cleaning roller is rotated together with the charging roller.

In the peeling evaluation based on the rotation, after the charging roller is rotated at a rotating speed of 500 rpm for 240 hours, whether or not the peeling of the end of the elastic layer in the longitudinal direction occurs in the cleaning roll is determined. The determination of the peeling is made by visual inspection based on the same criteria as described above. As a bearing, a ball bearing corresponding to the diameter of the core, that is the shaft diameter is used.

Followability Evaluation

When the charging roller is rotated at a rotating speed of 500 rpm, the initial rotating speed of the cleaning roller and the rotating speed of the clearing roller after being rotated for 240 hours are measured using a non-contact tachometer to evaluate the followability based on the following criteria. The results are shown in Tables 2 and 3.

Followability Evaluation: Criteria

G1: 90% or higher of the theoretical rotating speed of the cleaning roller per minute G2: 80% or higher of the theoretical rotating speed of the cleaning roller per minute G3: Lower than 80% of the theoretical rotating speed of the cleaning roller per minute.

TABLE 2

| | Example 1 | Example 2 | Example 3 | Example 4 | Example 5 | Example 6 | Example 7 |
|---|---|---|---|---|---|---|---|
| Core Diameter (mm) | 12 | 8 | 8 | 6 | 6 | 4 | 3 |
| Core Radius R (mm) | 6 | 4 | 4 | 3 | 3 | 2 | 1.5 |
| Width W1 (mm) of Elastic Layer | 6 | 4 | 2 | 3 | 3 | 2 | 1 |
| Spiral Angle θ (°) | 45 | 75 | 45 | 30 | 15 | 8 | 4 |
| Thickness D (mm) of Elastic Layer | 15 | 10 | 2.5 | 5 | 2.5 | 2.5 | 2.5 |
| Winding Number | 5 | 27 | 7 | 6 | 3 | 2 | 1.3 |
| Material of Elastic Member | Urethane Foam | Urethane Foam | Urethane Foam | Urethane Foam | Urethane Foam | Urethane Foam | Urethane Foam |
| Model No. | EP70 | EP70 | EP70 | EP70 | EP70 | EP70 | EP70 |
| Manufacturer | INOAC | INOAC | INOAC | INOAC | INOAC | INOAC | INOAC |
| *Peeling after Storage | G1 | G2 | G1 | G1 | G1 | G1 | G1 |
| **Peeling after Rotation | G2 | G2 | G1 | G1 | G1 | G1 | G1 |
| Followability (Initial) | G1 | G1 | G1 | G1 | G1 | G1 | G2 |
| Followability (after Rotation) | G1 | G1 | G1 | G1 | G1 | G1 | G2 |

| | Example 8 | Example 9 | Example 10 | Example 11 | Example 12 | Example 13 |
|---|---|---|---|---|---|---|
| Core Diameter (mm) | 2 | 6 | 2 | 12 | 4 | 12 |
| Core Radius R (mm) | 1 | 3 | 1 | 6 | 2 | 6 |
| Width W1 (mm) of Elastic Layer | 1 | 3 | 1 | 6 | 1.5 | 6 |
| Spiral Angle θ (°) | 2 | 15 | 1.9 | 77 | 6 | 60 |
| Thickness D (mm) of Elastic Layer | 1 | 2.5 | 4 | 15 | 0.7 | 17 |
| Winding Number | 1 | 2.6 | 0.95 | 21 | 1.5 | 8 |
| Material of Elastic Member | Urethane Foam | Melamine Foam | Urethane Foam | Urethane Foam | Urethane Foam | Urethane Foam |
| Model No. | EP70 | BASOTECT W | EP70 | EP70 | EP70 | EP70 |
| Manufacturer | INOAC | BASF | INOAC | INOAC | INOAC | INOAC |
| *Peeling after Storage | G1 | G1 | G2 | G2 | G1 | G2 |
| **Peeling after Rotation | G2 | G1 | G2 | G2 | G1 | G2 |
| Followability (Initial) | G2 | G1 | G2 | G1 | G2 | G1 |
| Followability (after Rotation) | G2 | G1 | G2 | G1 | G2 | G1 |

*The peeling of the end of the elastic layer in the longitudinal direction after the storage

**The peeling of the end of the elastic layer in the longitudinal direction after the rotation

TABLE 3

| | Comparative Example 1 | Comparative Example 2 | Comparative Example 3 | Comparative Example 4 | Comparative Example 5 | Comparative Example 6 |
|---|---|---|---|---|---|---|
| Core Diameter (mm) | 12 | 4 | 6 | 4 | 4 | 2 |
| Core Radius R (mm) | 6 | 2 | 3 | 2 | 2 | 1 |
| Width W1 (mm) of Elastic Layer | 12 | 3 | 4 | 3 | 0.7 | 1.5 |
| Spiral Angle θ (°) | 78 | 45 | 30 | 15 | 4 | 1.8 |
| Thickness D (mm) of Elastic Layer | 15 | 5 | 18 | 0.7 | 5 | 10 |
| Winding Number | 22 | 14 | 5.5 | 4 | 1 | 0.9 |
| Material of Elastic Member | Urethane Foam | Urethane Foam | Urethane Foam | Urethane Foam | Urethane Foam | Urethane Foam |
| Model No. | EP70 | EP70 | EP70 | EP70 | EP70 | EP70 |
| Manufacturer | INOAC | INOAC | INOAC | INOAC | INOAC | INOAC |
| *Peeling after Storage | G3 | G3 | G3 | G2 | G1 | G2 |

TABLE 3-continued

| | Comparative Example 1 | Comparative Example 2 | Comparative Example 3 | Comparative Example 4 | Comparative Example 5 | Comparative Example 6 |
|---|---|---|---|---|---|---|
| **Peeling after Rotation | Not Performed | Not Performed | Not Performed | G3 | G3 | G3 |
| Followability (Initial) | Not Performed | Not Performed | Not Performed | G1 | G2 | G3 |
| Followability (after Rotation) | Not Performed | Not Performed | Not Performed | G3 | G3 | G3 |

*The peeling of the end of the elastic layer in the longitudinal direction after the storage
**The peeling of the end of the elastic layer in the longitudinal direction after the rotation It can be seen from the above results that, in Examples, even when being stored in a high-temperature and high-humidity environment (45° C./95% RH) for one month and subsequently in a low-temperature and low-humidity environment (10° C./15% RH) for one month, the peeling of the end of the elastic layer in the longitudinal direction is prevented without performing a pressure-bonding process thereon as compared to Comparative Examples. Further, it can be seen that, even when the cleaning roller, that is the cleaning member is rotated after the storage in the high-temperature and high-humidity environment and the low-temperature and low-humidity environment, the peeling of the end of the elastic layer in the longitudinal direction is prevented. In addition, it can be seen that, in Examples, even after the storage in the high-temperature and high-humidity environment and the low-temperature and low-humidity environment, the followability to the charging roller is superior as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a core; and an elastic layer comprising a strip-shaped elastic member that is spirally wound around a region of an outer peripheral surface of the core ranging from one end to another end of the core, wherein a width W1 of the elastic layer is less than or equal to a radius R of the core, is 1 mm or more, and is from ¼ to ½ of a diameter of the core, and the diameter of the core is from 8 mm to 12 mm.

2. The cleaning member according to claim 1, wherein the elastic layer comprises the elastic member that is spirally wound with an angle of from 2° to 75° with respect to an axial direction of the core.

3. The cleaning member according to claim 1, wherein the elastic layer comprises the elastic member that is spirally wound with an angle of from 4° to 45° with respect to an axial direction of the core.

4. The cleaning member according to claim 1, wherein a thickness D of the elastic layer is from 1 mm to 15 mm.

5. The cleaning member according to claim 1, wherein a thickness D of the elastic layer is from 2 mm to 5 mm.

6. A process cartridge that is detachable from an image forming apparatus, the process cartridge comprising:

a charging device, wherein the charging device includes a charging member that charges a charging object, and the cleaning member according to claim 1 that is disposed in contact with a surface of the charging member and cleans the surface of the charging member.

7. A process cartridge that is detachable from an image forming apparatus, the process cartridge comprising:

a transfer device, wherein the transfer device includes a transfer member that transfers a transfer object onto a transfer medium, and the cleaning member according to claim 1 that is disposed in contact with a surface of the transfer member and cleans the surface of the transfer member.

8. An image forming apparatus comprising:

an electrophotographic photoreceptor;

a charging device that includes a charging member and the cleaning member according to claim 1, the charging member charging a surface of the electrophotographic photoreceptor, and the cleaning member being disposed in contact with a surface of the charging member and cleaning the surface of the charging member;

an electrostatic latent image forming device that forms an electrostatic latent image on a charged surface of the electrophotographic photoreceptor;

a developing device that develops an electrostatic latent image, which is formed on the surface of the electrophotographic photoreceptor, using a developer containing toner to form a toner image on the surface of the electrophotographic photoreceptor; and a transfer device that transfers the toner image onto a surface of a recording medium.

9. An image forming apparatus comprising:

an electrophotographic photoreceptor;

a charging device that charges a surface of the electrophotographic photoreceptor;

an electrostatic latent image forming device that forms an electrostatic latent image on a charged surface of the electrophotographic photoreceptor;

a developing device that develops an electrostatic latent image, which is formed on the surface of the electrophotographic photoreceptor, using a developer containing toner to form a toner image on the surface of the electrophotographic photoreceptor; and a transfer device that includes a transfer member and the cleaning member according to claim 1, the transfer member transferring the toner image onto a recording medium, and the cleaning member being disposed in contact with a surface of the transfer member and cleaning the surface of the transfer member.

* * * * *